US005339635A

United States Patent [19]

Iwai et al.

[11] Patent Number: 5,339,635

[45] Date of Patent: Aug. 23, 1994

[54] GAS TURBINE COMBUSTOR OF THE COMPLETELY PREMIXED COMBUSTION TYPE

[75] Inventors: Yasuo Iwai, Katsuta; Shigeru Azuhata; Kenichi Sohma, both of Hitachi; Kiyoshi Narato, Taga; Hironobu Kobayashi, Katsuta; Tooru Inada, Hitachi; Tadayoshi Murakami, Hitachi; Norio Arashi, Hitachi; Yoji Ishibashi, Hitachi; Michio Kuroda, Hitachi, all of Japan

[73] Assignee: Hitachi, Ltd., Tokyo, Japan

[21] Appl. No.: 918,799

[22] Filed: Jul. 27, 1992

Related U.S. Application Data

[63] Continuation of Ser. No. 675,546, Mar. 25, 1991, abandoned, which is a continuation of Ser. No. 362,382, May 4, 1989, abandoned.

[30] Foreign Application Priority Data

Sep. 4, 1987 [JP] Japan ..... 62-220206

[51] Int. Cl.[5] ..... F23R 3/34

[52] U.S. Cl. ..... 60/733; 60/737; 60/746

[58] Field of Search ..... 60/733, 737, 738, 742, 60/746, 748, 747, 39.06

[56] References Cited

U.S. PATENT DOCUMENTS 3,919,840 11/1975 Markowski ..... 60/737
3,943,705 3/1976 DeCorso et al. ..... 60/746
4,237,694 12/1980 Wood et al. ..... 60/738
4,967,561 11/1990 Bruhwiler et al. ..... 60/746

FOREIGN PATENT DOCUMENTS 095788 4/1983 European Pat. Off. .

OTHER PUBLICATIONS

"The Aircraft Gas Turbine Engine and Its Operation", United Technologies, P&W Oper. Instr 200, 1974 p. 85.
Lefebvre, Arthur H. "Gas Turbine Combustion," McGraw-Hill, New York, 1983 pp. 4–7.

*Primary Examiner*—Richard A. Bertsch
*Assistant Examiner*—Timothy S. Thorpe
*Attorney, Agent, or Firm*—Antonelli, Terry, Stout & Kraus

[57] ABSTRACT

A gas turbine combustor of the pre-mixed combustion system in which the pre-mixed fuel and the air are combusted. The gas turbine combustor comprises main cylindrical nozzles provided in the end wall on the upstream side of a cylindrical combustion chamber, auxiliary nozzles formed to surround the main nozzles, a main pre-mixed gas supply for supplying a pre-mixed gas to the main nozzles, and an auxiliary pre-mixed gas supply for supplying a pre-mixed gas having an fuel/air ratio smaller than that of the main pre-mixed gas to the auxiliary nozzles, and wherein it is allowed to stably burn a lean pre-mixed gas having an fuel/air ratio of greater than 1 from a low-load condition through and up to a high-load condition of the gas turbine.

4 Claims, 8 Drawing Sheets

GAS TURBINE COMBUSTOR OF THE COMPLETELY PREMIXED COMBUSTION TYPE

This application is a continuation of application Ser. No. 07/675,546, filed Mar. 25, 1991, which is a continuation of application Ser. No. 07/362,382, filed May 4, 1989, both now abandoned.

The present invention relates to a gas turbine combustor, and, more specifically, to a gas turbine combustor of a pre-mixed combustion type in which a fuel and the air are mixed together prior to being combusted and a method of combustion.

Thermal NOx formed by the oxidation of nitrogen in the air for combustion in a high-temperature atmosphere occupy a majority proportion of nitrogen oxides (NOx) that generate when a gaseous fuel containing small amounts of nitrogen such as liquefied natural gas (LNG) burns. It has been known that formation of thermal NOx varies greatly depending upon the temperature, i.e., the amount of formation thermal NOx increases with the increase in the flame temperature, and increases abruptly when the temperature exceeds 1500° C. The flame temperature changes depending upon the mixing ratio of the fuel and the air, and becomes the highest when the fuel is combusted with the air of a quantity that is not too great or is not insufficient for completely combusting the fuel, i.e., becomes the highest when the fuel is combusted near a theoretical, e.g. stoichiometric, air requirement. To suppress the generation of NOx, the flame temperature must be lowered. The flame temperature can be lowered by a method in which water or vapor is blown into the combustion chamber to forcibly lower the temperature, or by a method in which the fuel is combusted under the condition where the mixing ratio of the fuel and the air is extremely increased to be greater than the theoretical air requirement or, conversely, is decreased.

The method of blowing water or vapor involves a new problem, namely, a decrease in the turbine efficiency.

In an ordinary combustion apparatus, a so-called diffused flame takes place in which the fuel and the air are injected from separate nozzles, and are mixed together in the combustor and are combusted, in order to stabilize the flame and to prevent backfire. In a step of mixing the fuel and the air together, however, a region wherein the fuel/air ratio (ratio of the air flow rate to the theoretical air requirement) becomes close to 1 and the flame temperature becomes locally high. That is, a region is formed where NOx are generated in large amounts, i.e., NOx are emitted in large amounts.

In contrast with the combustion apparatus which utilizes the diffused flame, there is a combustion apparatus which uses pre-mix flame in which the air in excess of the theoretical air requirement and the fuel are mixed together in advance and are injected into the combustor. In the pre-mix flame having a high fuel/air ratio, the region where the temperature becomes locally high is prevented from taking place and NOx are emitted in reduced amounts. The pre-mix flame remains most stable when the ratio is close to 1, but tends to be blown out when the injection speed increases. When the injection speed is low, furthermore, flame enters into the nozzle to cause backfire. In the combustor of a gas turbine, the pre-mix gas consisting of the fuel and the air must be injected at a high speed of, usually, 40 m/s to 70 m/s, but the flame is not easily formed under such high injection speed conditions. Japanese Patent Laid-Open No. 22127/1986 proposes a combuster in which the fuel is supplied in a divided manner, with part of the fuel being used for forming diffused flame and the remainder being used for forming pre-mix flame, and relatively stable diffused flame or combustion gas of a high temperature formed by the diffused flame is used for igniting the pre-mix flame. The above combustor makes it possible to decrease the amount of NOx compared with the conventional combustor that utilizes the diffused flame. The amount of NOx can be decreased if the flow rate of the fuel used for the diffused flame is decreased and the fuel flow rate of pre-mixed flame is increased. However, the flame loses stability if the rate of pre-mixing increases, and limitation is imposed on decreasing the amount of NOx emission.

The amount of NOx generated from the gas turbine combustor can be decreased if unstable pre-mix flame is stabilized and if the gas turbine combustion system is employing the type of completely pre-mixed combustion.

When the gas turbine combustion system is of the type employing completely pre-mixed combustion, the air for combustion is supplied in large amounts compared with the fuel flow rate during the small-load operation conditions, whereby the fuel becomes lean and is difficult to ignite. During high-load operation conditions, both the fuel supply and the air flow rate are increased, whereby the flow rate of the pre-mixed gas is further increased causing the pre-mix flame to be blown out.

The object of the present invention is to provide a gas turbine combustor which is capable of stably burning a lean pre-mixed gas having an fuel/air ratio of greater than 1 from low load through up to high load of the gas turbine, and a method of combustion.

The above-mentioned object is achieved by a gas turbine combustor which comprises main cylindrical nozzles provided in the end wall on the upstream side of a cylindrical combustion chamber, auxiliary nozzles formed around the circumference of the main nozzles, main pre-mixed gas supply means for supplying a pre-mixed gas to the main nozzles, and auxiliary pre-mixed gas supply means for supplying a pre-mixed gas having an fuel/air ratio smaller than that of said main pre-mixed gas to said auxiliary nozzles. The object is further achieved by a method of pre-mixed combustion for a gas turbine combustor in which the pre-mixed gas injected from the openings of the main cylindrical nozzles is combusted with a pre-mixed flame formed around the outer circumferences of the openings of the main nozzles.

According to the present invention, stable auxiliary flame is formed at all times at the root of the combustion flame of a high fuel/air ratio in order to maintain the main flame that combusts at high speeds. Therefore, the gas turbine combustion system is of the completely pre-mixed combustion type. Hence, if lean combustion is carried out while setting the fuel/air ratio of the fuel-air mixture gas for main flame to be greater than 1.0, it is allowed to decrease the amounts of NOx and CO that are polluting substances generated from the gas turbine combustor.

DETAILED DESCRIPTION

Figure 1:
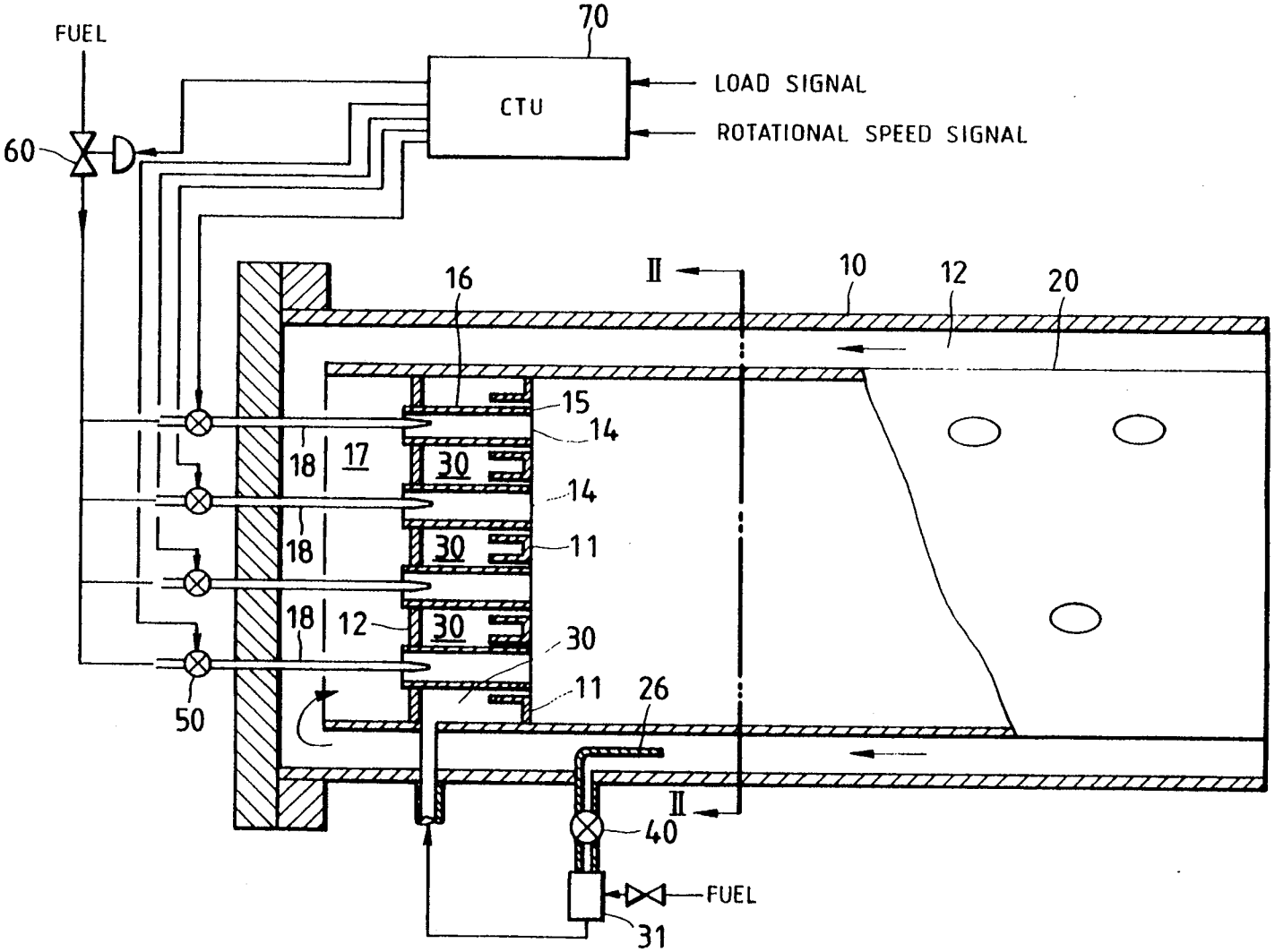
FIG. 1 is a longitudinal cross-sectional view of a portion of a gas turbine combustor embodying the present invention.
Figure 2:
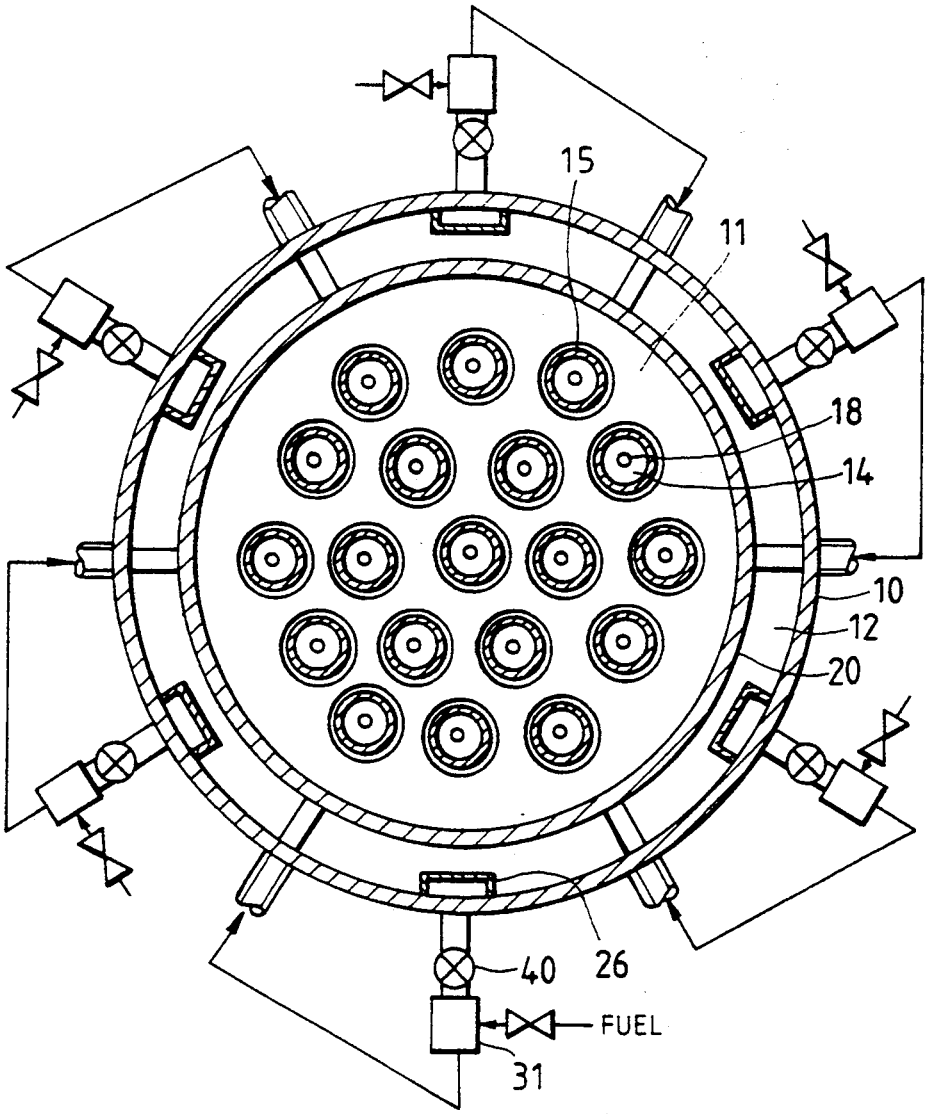
FIG. 2 is a cross-sectional taken along the line II—II in FIG. 1.

Referring now to the drawings wherein like references numerals are used throughout the various views to designate like parts and, more particularly, to FIG. 1, according to this figure, a gas turbine combustor includes an inner cylinder 20 arranged concentrically in an outer cylinder 10, and an annular space is defined between the outer cylinder 10 and the inner cylinder 20 constituting an air path 13 for guiding the air blown from the compressor to the head portion of the inner cylinder. Double end walls 11 and 12 are provided at the head of the inner cylinder 20, and, in the inner end wall 11, are formed main nozzles 14 and surrounding auxiliary nozzles 15 over the entire surface thereof as shown in FIG. 2. The main nozzles 14 are formed at the right end of pre-mixing cylinders 16 that extend on the side of the outer end wall 12 penetrating therethrough. The pre-mixing cylinders 16 introduce the air from an air chamber 17 formed on the left side of the end wall 12. Fuel supply pipes 18 are inserted in the pre-mixing cylinders 16, and the fuel injected from the ends of the fuel supply pipes 18 is mixed with the air as it flows through the cylinders 16 to thereby form a pre-mixed gas. Auxiliary nozzles 15 are communicated with auxiliary pre-mixing chambers 30 formed between the end walls 11 and 12. The chambers 30 are supplied with a uniformly pre-mixed gas from a venturi-type mixer 31. High pressure air is introduced into the mixer 31 by an introduction board 26 via an air adjusting valve 40, and the fuel adjusted under the atmospheric pressure, is suction to form a uniformly pre-mixed gas. The fuel supply pipes 18 are communicated with a main fuel adjusting valve 60 via stop valves 50 provided for each of the pipes 18. The valves 50 and 60 are controlled according to instructions from a controller 70 which receive load signals of the gas turbine and rotational speed signals.

Figure 4:
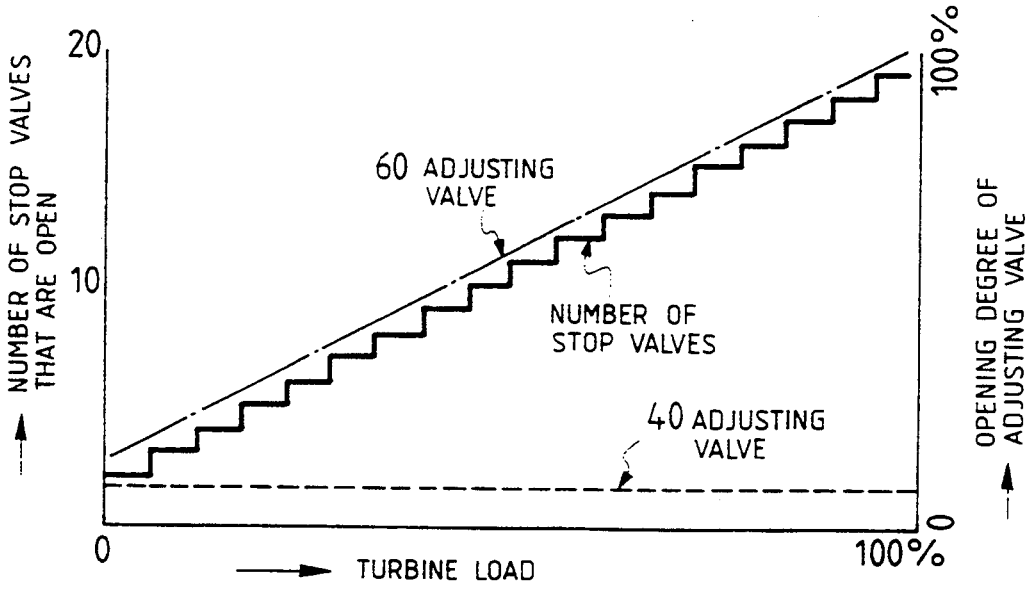
FIG. 4 is a graphical illustration of a relationship between the turbine load and the opening degree of valves shown in FIG. 1.

The stop valves 50 are fully opened upon receipt of an open signal from the controller 70 and are fully closed in other cases. FIG. 1 illustrates only four stop valves, however, stop valves are provided for all fuel supply pipes 18 and, in the embodiment of FIG. 1, nineteen stop valves are provided. The number of stop valves that open increases with the increase in the load of the turbine as shown in FIG. 4. On the other hand, the opening degree of the adjusting valve 60 varies nearly in proportion to the turbine load. The adjusting valve 40 maintains nearly a constant opening degree (about 10%) irrespective of the turbine load. The pre-mixed air to be introduced into the auxiliary pre-mixing chambers 30 is uniformly pre-mixed in the mixer 31 so as to have an fuel/air ratio over a range of from 0.8 to 1.2. Further, the air adjusting valve 40 is so adjusted that the speed of injection from the auxiliary nozzles 15 will become nearly equal to the speed of combustion.

In operating the gas turbine, first the air adjusting valve 40 for auxiliary flame is opened to form the auxiliary pre-mixed gas through the mixer 31. Next, the pre-mixed gas injected from the auxiliary nozzles 15 is ignited by ignition plugs (not shown). The auxiliary pre-mixed gas has an fuel/air ratio which is close to 1, i.e., which lies from 0.8 to 1.2, and the speed of injection is nearly equal to the speed of combustion, i.e., 0.4 m/s. Therefore, the auxiliary pre-mixed gas is reliably ignited and stably sustains the combustion after it is ignited.

Figure 3:
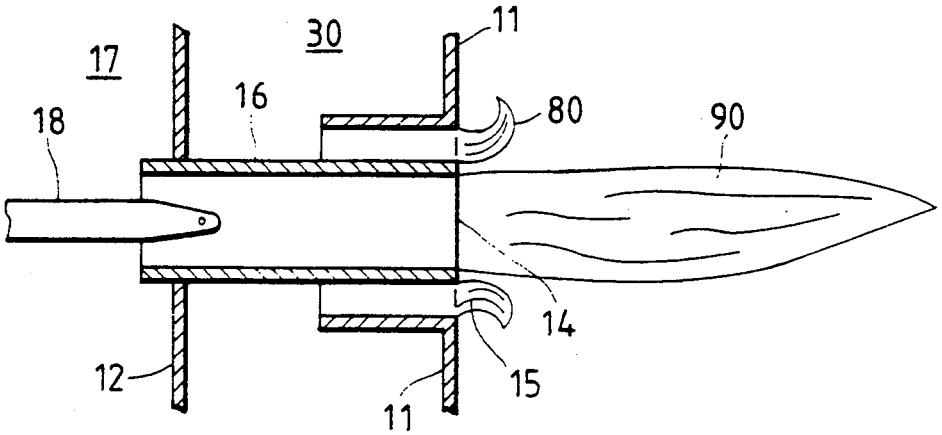
FIG. 3 is a cross-sectional view of a detail of a nozzle portion of FIG. 1.

In this case, the stop valves 50 are mostly closed, and the air only is injected from the main nozzles 14. The opening degree of the adjusting valve 60 gradually increases in response to load signals of the turbine, and the stop valves 50 are opened according to a predetermined order. Then, a pre-mixed gas is formed in the pre-mixing cylinders 16 and is injected at high speeds from the main nozzles 14. The pre-mixed gas injected from the main nozzles 14 is ignited by an auxiliary flame 80 (FIG. 3) formed there around to thereby establish a main flame 90.

As the stop valves 50 are successively opened, the number of flames formed by the main nozzles 14 increases gradually, and the flames are formed by all main nozzles 14 under the rated load condition. In a gas turbine for generating electricity, in general, the turbine rotates at a constant speed from 0% to 100% of load, and the air supplied to the combustor flows nearly at a constant rate. Therefore, the air flows nearly at a constant rate from the air chamber 17 into the pre-mixing cylinders 16.

The amount of fuel that flows through the adjusting valve 60, varies nearly in proportion to the turbine load. However, since the number of stop valves 50 that open varies independence upon the amount of fuel, the amount of fuel supplied to the pre-mixing cylinders 16 remains nearly the same per stop valve that is open, and the fuel/air ratio of the mixture gas formed in the pre-mixing cylinders 16 does not change to any great extent, therefore, the fuel/air ratio is set to lie from 1.2 to 2.5.

In this embodiment in which the fuel/air ratio of the pre-mixed gas in the auxiliary nozzles 15 is set near to 1 to favorably maintain the flame, there is no likelihood that the flame is blown out even when the pre-mixed gas is injected from the main nozzles 14 at a speed greater than 20 m/s and, preferably, at a speed of 40 m/s to 70 m/s. Further, since the air is constantly injected from the main nozzles 14 at a speed of 20 m/s to 70 m/s, backfiring occurs.

Moreover, even though the pre-mixed gas from the main nozzles 14 is so lean so as to have an fuel/air ratio of 1.5 or more, the combustion is stably sustained due to the auxiliary flame.

Figure 5A:
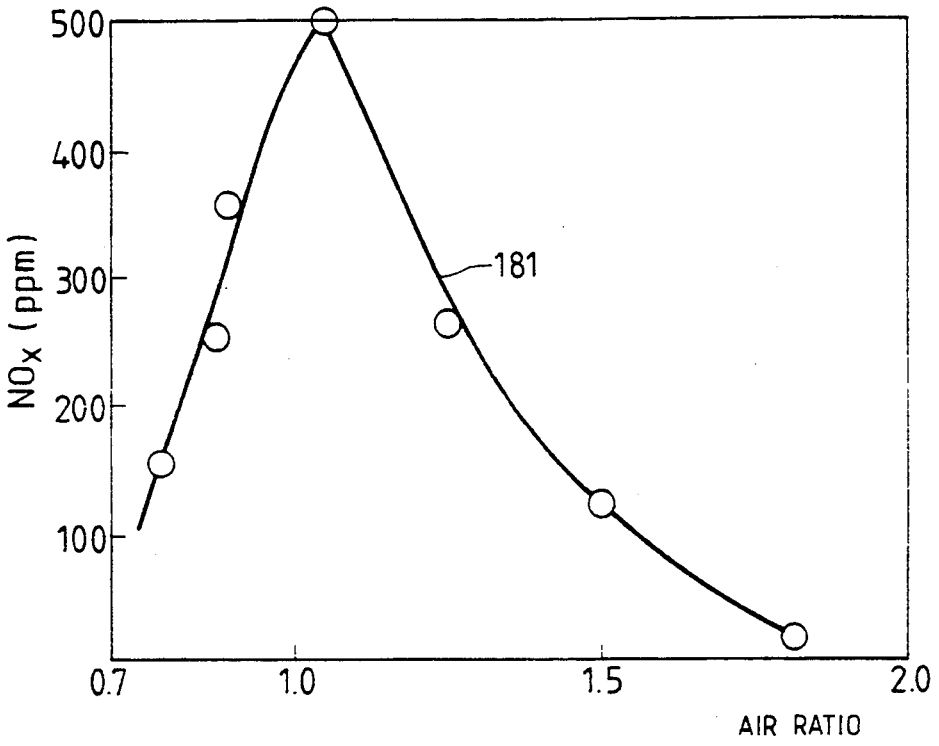
FIGS. 5(*a*) and 5(*b*) are graphical illustrations of relationships between the amount of NOx generated and the amount of CO generated when the pre-mixed gas is combusted while changing the fuel/air ratio.
Figure 5B:
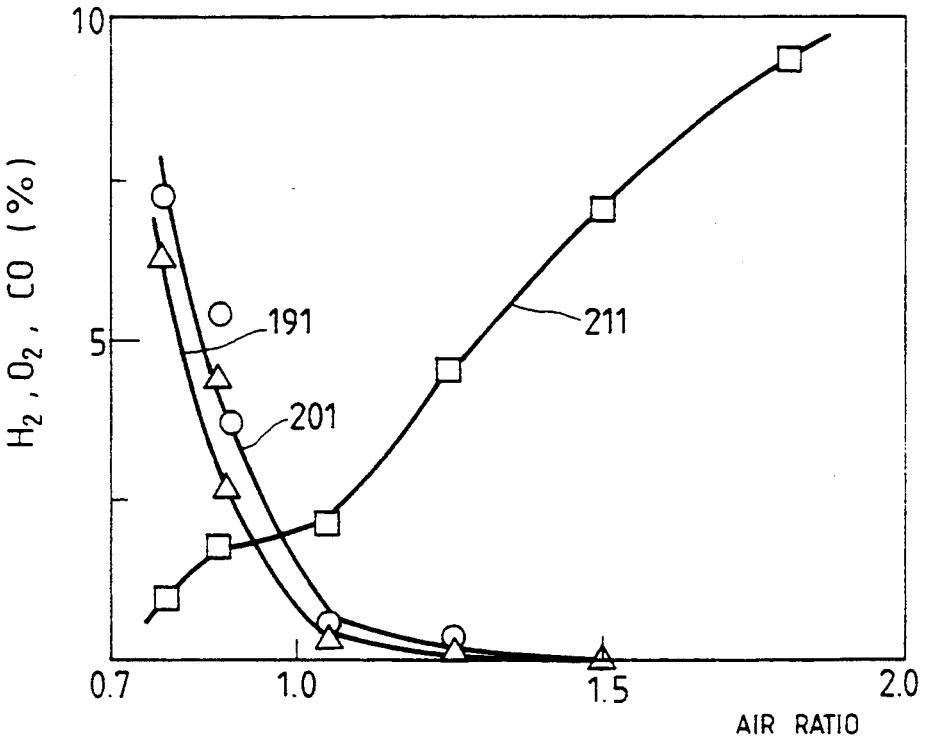

FIGS. 5(*a*), 5(*b*) and 6(*a*), 6(*b*) illustrate relationships between the amount of NOx generated and the amounts of $H_2$ and CO generated when the pre-mixed gas is burned while changing its fuel/air ratio. FIG. 5(*a*), (*b*) depict the analyzed results of exhaust gas from the combustion cylinder of when the pre-mix flame is formed in the combustion cylinder having an inner diameter of 90 mm and a height of 346 mm, and FIG. 6(*a*), (*b*) depict the analyzed results of exhaust gas from the combustion cylinder when the pre-mix flame is formed in the combustion cylinder having an inner diameter of 208 mm and a height of 624 mm, both under the same combustion conditions.

Figure 6A:
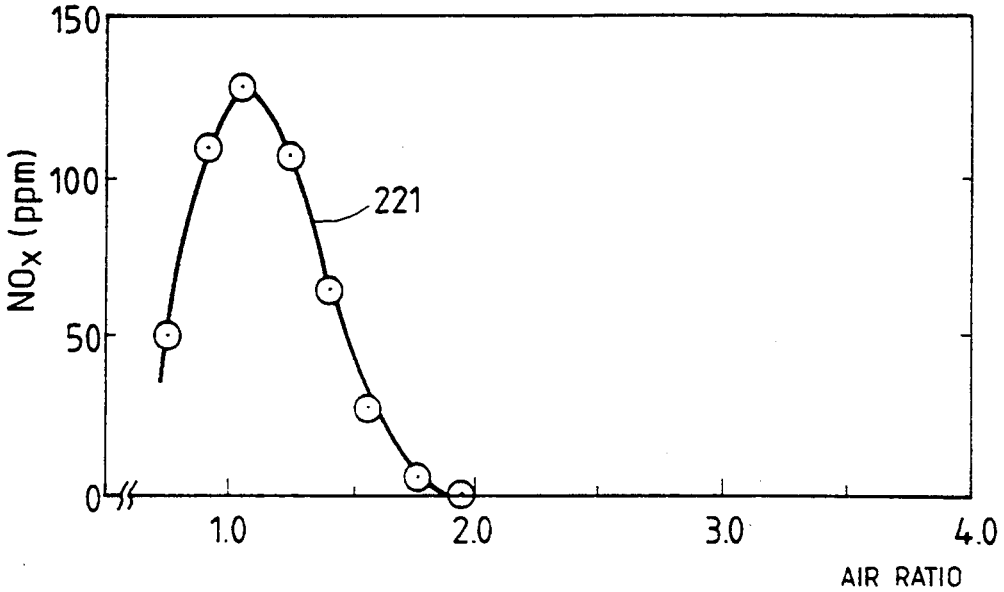
FIGS. 6(*a*) and 6(*b*) are graphical illustrations of exhaust gas compositions from the combustor of the present invention up to a region of an fuel/air ratio of as high as 3.6.
Figure 6B:
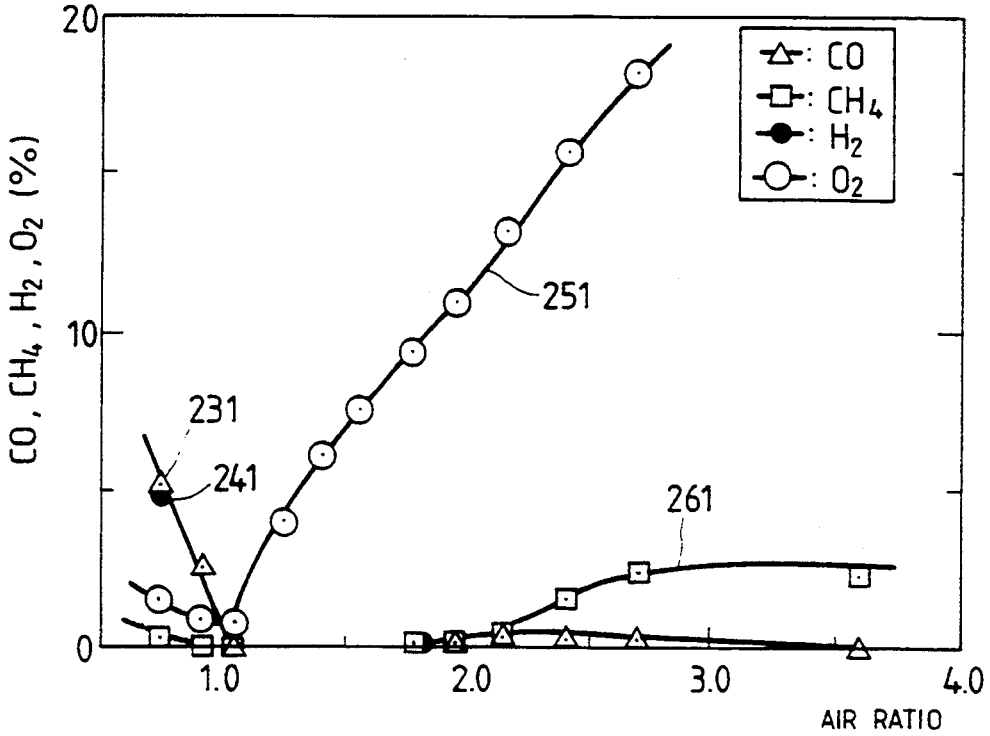

FIG. 6(*a*), (*b*) illustrate the analysis of exhaust gas of up to the region of an fuel/air ratio of as high as 3.6. In FIGS. 6(*a*) and 5(*b*), where the main flame is formed with the fuel/air ratio from 1.3 to 1.8, the amount of NOx is less than 100 ppm as indicated by a curve 221, and CO and $H_2$ are not almost formed as indicated by curves 231 and 241. Oxygen exhibits behavior as represented by a curve 251, as a matter of course.

Looking from these behaviours, it appears that NOx are generated in large amounts since the fuel/air ratio of the pre-mixed gas in the auxiliary nozzles is close to 1. As a whole, however, NOx are generated in small amounts since the fuel/air ratio of auxiliary flame is about 10% under the rated load condition.

Figure 7:
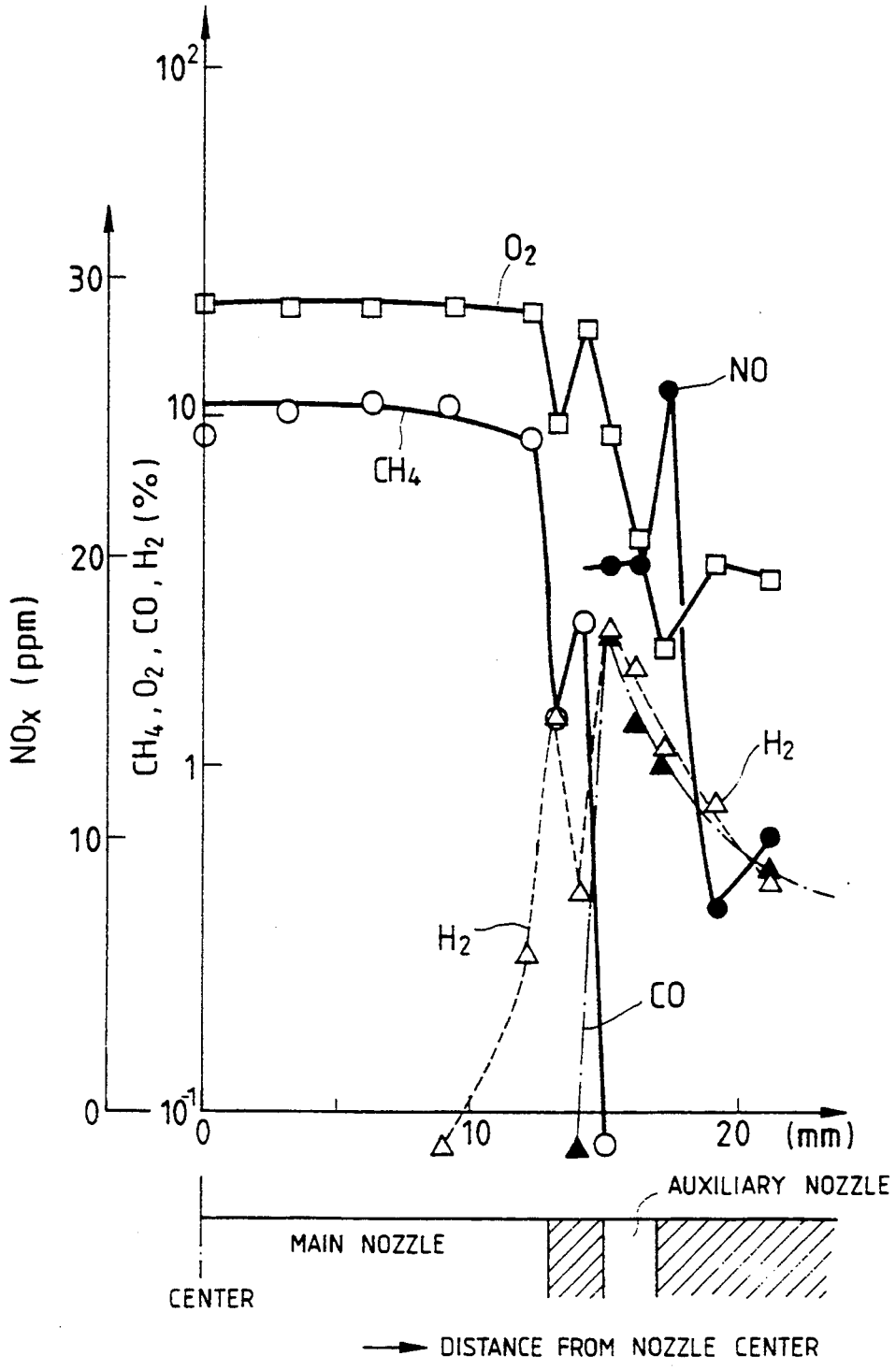
FIG. 7 is a graphical illustration of combustion exhaust gas composition of flame in the radial direction of the nozzle.

In FIG. 7, the fuel gas is sampled and is analyzed at a point 5 mm away from the main nozzle 14 (having an inner diameter of about 26 mm) in the downstream direction by moving a sampling probe in the radial direction from the center of the nozzle 14, to examine the combustion condition in the main flame and near the auxiliary flame. As apparent from FIG. 7, $CH_4$ is not completely combusted in the main flame but combusts toward the auxiliary flame and is combusted by 100% over the auxiliary flame nozzle. This fact indicates that the flame is reliably transferred from the auxiliary flame of auxiliary nozzle to the pre-mixed gas of the main nozzle 14. The size of the burner used in this embodiment is as follows: i.e., the main nozzle 14 has an inner diameter of 26 mm, the spacer surrounding the main nozzle 14 has a thickness of 2 mm, and the auxiliary nozzle 15 has a width of 2 mm.

Figure 9:
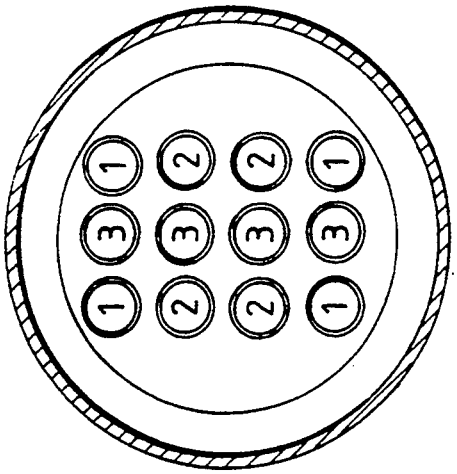
FIG. 9 is a cross-sectional view taken along the line IX—IX in FIG. 8.
Figure 8:
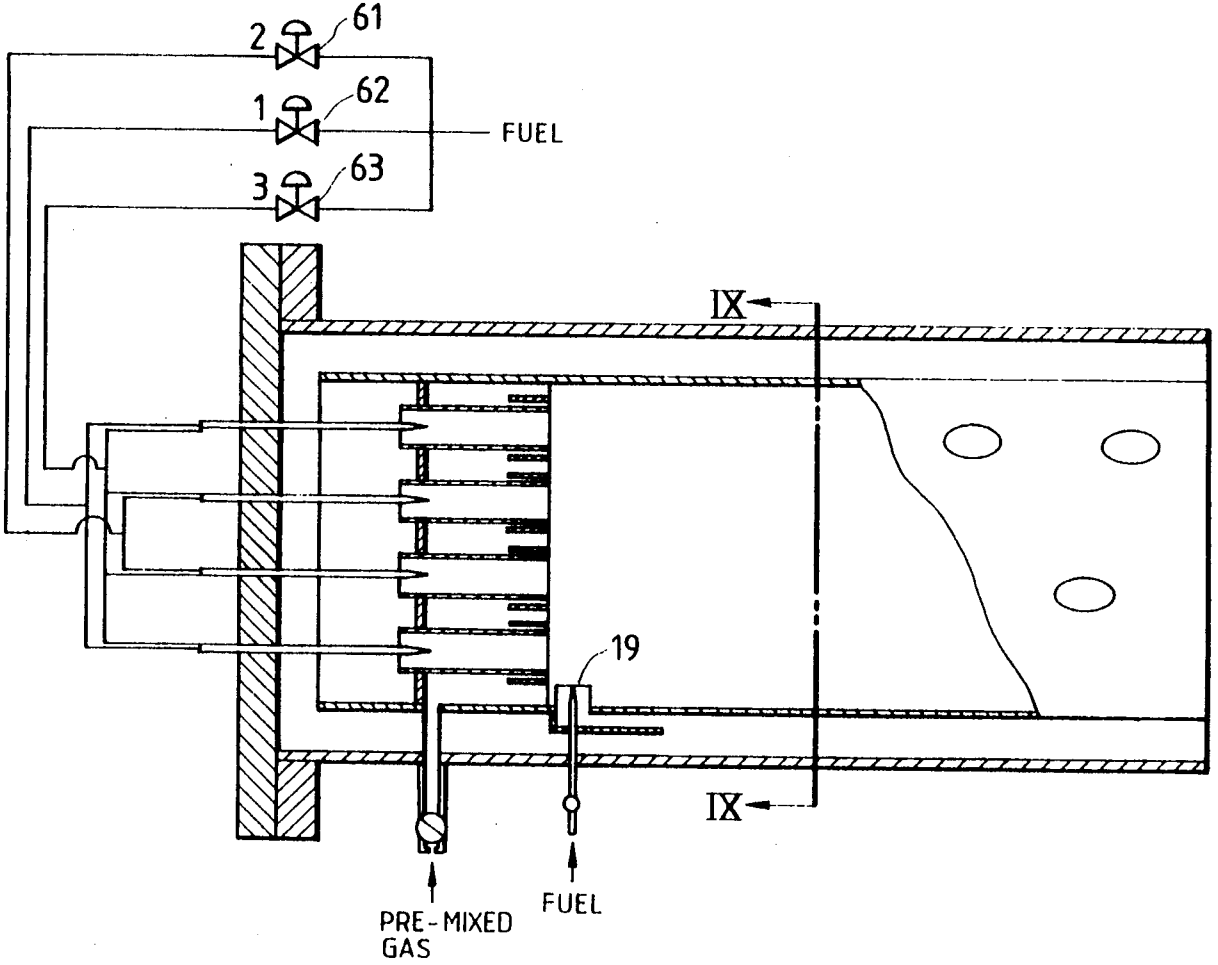
FIG. 8 is a longitudinal cross-sectional view of a portion of the gas turbine combustor according to another embodiment of the present invention.

FIG. 8 illustrates a gas turbine combustor in which a plurality of main nozzles 14 provided in the end wall on the head side of the inner cylinder 20 of the combustor are classified into three groups, and the amounts of fuel supplied to the nozzle groups are independently increased or decreased such that the air ratio of the fuel-air mixture injected from the main nozzles 14 will lie from 1.2 to 2.5 when the turbine load is varied over a range of 20% to 100%, in order to suppress the amounts of NOx and CO generated from the combustor. Numerals on the main nozzles in the front view of the combustor of FIG. 9 represent classification numbers of the main nozzles grouped into three. Each nozzle group has four main nozzles. Reference numerals 61, 62 and 63 denote flow-rate adjust valves; i.e., 61 denotes the adjust valve for increasing or decreasing the amount of fuel supplied to the second nozzle group, 62 denotes the adjust valve for the first nozzle group and 63 denotes the adjust valve for the third nozzle group. Reference numeral 19 denotes a burner for diffused flame for igniting the pilot flame formed by the auxiliary nozzles. After the pilot flame is formed for the auxiliary nozzles, no fuel is supplied to the burner 19 and its flame is extinguished.

Figure 10:
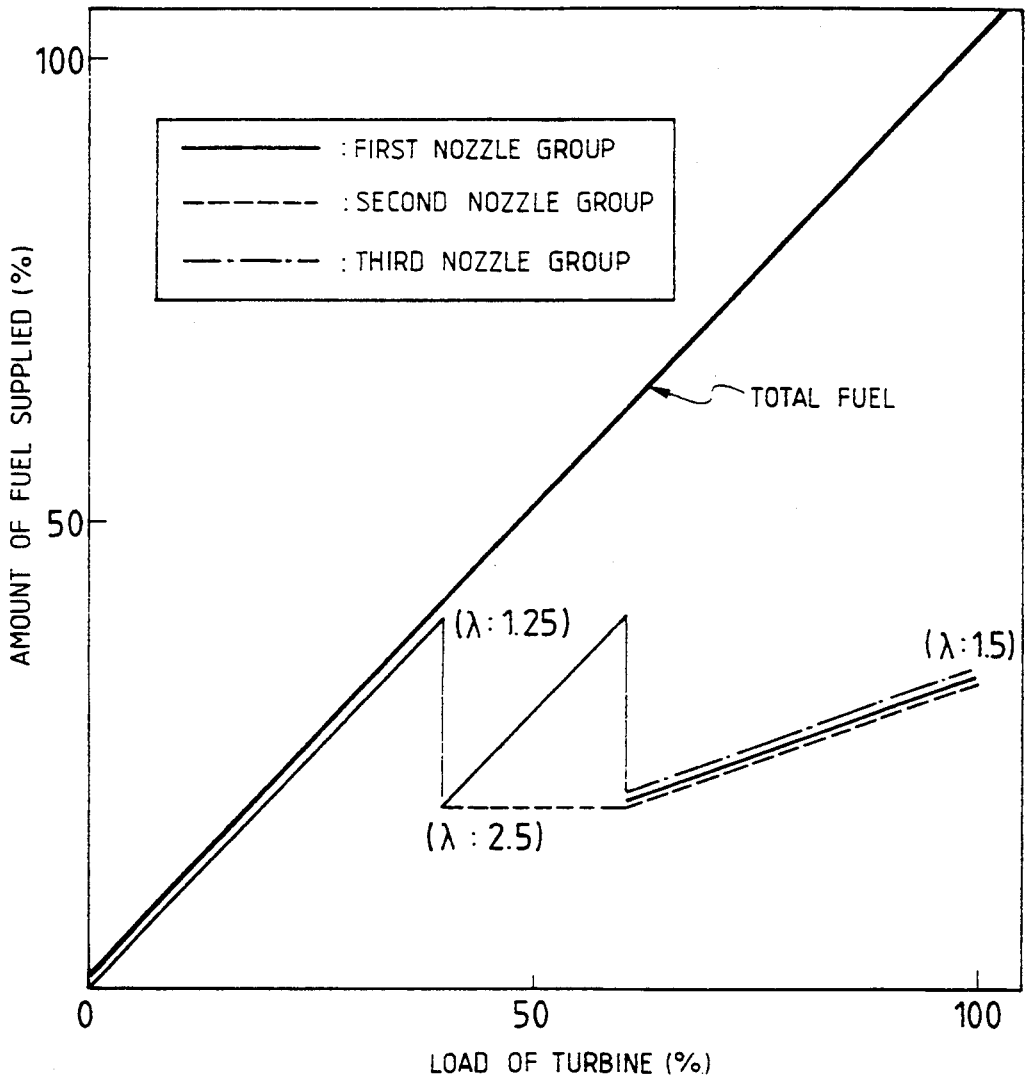
FIG. 10 is a graphical illustration depicting relationships between the change of load and the fuel supply system in the gas turbine combustor of FIG. 8.

FIG. 10 shows changes in the amounts of fuel supplied to the nozzle groups when the load of the gas turbine combustor of FIG. 8 is changed. The fuel is supplied to the first nozzle group only over the turbine load of from 0% to 39%. At a moment when the fuel/air ratio of the fuel-air mixture injected from the main nozzles of the first nozzle group has reached 1.25, the supply of fuel is decreased such that the fuel/air ratio becomes 2.5. At the same time, the fuel is supplied to the second nozzle group so that the fuel/air ratio becomes 2.5, and the amount of fuel supplied to the first nozzle group is increased under the condition where the amount of fuel supplied to the second nozzle group is maintained constant, in order to increase the turbine load from 39% to 60%. Then, at a moment the fuel/air ratio of the fuel-air mixture of the first nozzle group reaches 1.25, the supply of fuel supplied to the first nozzle group is again decreased such that the fuel/air ratio of the first nozzle group becomes 2.5. At the same time, the fuel is supplied to the third nozzle group such that the fuel/air ratio becomes 2.5, and the amounts of fuel supplied to the first, second and third nozzle groups are increased proportionally from 60% to 100% of the turbine load. At 100% of the turbine load, the gas turbine combustor is so operated that the fuel/air ratio of the fuel-air mixture injected from the first, second and third nozzles will be 1.5.

Under the gas turbine operation conditions shown in FIG. 10, the fuel/air ratio of the fuel-air mixture injected from the first, second and third nozzle groups lies from 1.25 to 2.50 over the turbine load range of from 20% to 100%. As apparent from FIGS. 6(*a*) and 6(*b*), the amount of NOx generated is smaller than about 100 ppm over the air ratio range of from 1.25 to 2.50, and unburned components that include CO, $H_2$ and $CH_4$ are generated in very small amounts. It can therefore be said that the method of operating the gas turbine combustor can be effectively employed for the gas turbine combustion system that a small generation of NOx.

According to the present invention as described above, the auxiliary flame, injected at a low speed, is used for igniting the pre-mixed flame (main flame) that is injected at high speeds and for maintaining the flame. Therefore, the pre-mixed gas for forming the pilot flame that works to maintain the flame is injected at a speed which is the same as the speed of combustion, i.e., injected at a speed of about 0.4 m/s. Furthermore, the fuel/air ratio is set to lie from 0.8 to 1.2 to suppress the generation of NOx and to prevent the blow out. The entire circumference of the pre-mixed gas injected at high speeds is surrounded by the auxiliary flame for maintaining the flame, so that the heat generated by the flame for maintaining the flame is efficiently transferred to the main flame. Moreover, a spacer is provided between the burner for main flame and the burner for auxiliary flame, so that vortex current is stably formed between the burner injecting the pre-mixed gas for main flame and the burner injecting the pre-mixed gas for auxiliary flame due to a difference in the speed of injection between them. This helps promote the mixing of the pre-mixed gas of a high fuel/air ratio for main flame and the combustion gas from the auxiliary flame of a high temperature, enabling the main flame to be more easily ignited. When the main flame is to be separated from the auxiliary flame using a thin partition wall such as a knife edge instead of providing the spacer, it has been experimentally determined that the auxiliary flame is blown out under the condition where the flow of auxiliary flame is seriously affected by the ejection of the main flame and where the main flame is blown out. With the spacer being provided, however, the main flame and the auxiliary flame do not directly mix with each other near the burner outlet, but the two flames are only partly mixed with each other in the vortex current formed on the spacer portion. Accordingly, the auxiliary flame is stably formed at all times without being affected by the main flame, contributing to increasing the range of flow speed or fuel/air ratio in which the main flame can be stably formed.

We claim:

1. A gas turbine combustor of the completely pre-mixed combustion type comprising a combustion chamber;

a plurality of spaced main nozzles provided in an end wall of said combustion chamber and defining an upstream side of said combustion chamber;

an annular auxiliary nozzle formed around each of said main nozzles, the main nozzles being grouped into at least first, second and third groups;

first means for supplying to the main nozzles of each of the groups of main nozzles a pre-mixed fuel-air gas mixture having a mixing ratio of the fuel and the air wherein the proportion of air is larger than a stoichiometric air requirement for combustion of the fuel in the mixture;

second means for supplying to said auxiliary nozzles a pre-mixed fuel-air gas mixture having a mixing ratio of the fuel and the air wherein the proportion of air is smaller than that supplied by said first means for supplying; and control means for controlling said first means for supplying for progressively increasing the number of said groups of main nozzles to which a pre-mixed fuel-air gas mixture is supplied with an increase of load on the gas turbine combustor, wherein said control means controls said first means for supplying such that initially a first air stoichiometric ratio of the pre-mixed fuel-air gas mixture is supplied to the first group of said main nozzles and when the ratio is approximately 1.25 said control means starts operation of the second group of the main nozzles by causing said first means for supplying to supply a pre-mixed fuel-air gas mixture to the main nozzles of the second group.

2. The gas turbine combustor according to claim 1, wherein when the first air stoichiometric ratio of the pre-mixed fuel-air gas mixture supplied to the second group of the main nozzles reaches approximately 1.25, said control means starts operation of the third group of the main nozzles by causing said first means for supplying to supply a pre-mixed fuel-air gas mixture to the main nozzles of the third group.

3. The gas turbine combustor according to claim 1, wherein the first air stoichiometric ratio of the pre-mixed fuel-air gas mixture supplied to the first group of the main nozzles by the first means for supplying is approximately 2.5 at the start of an operation of the gas turbine combustor.

4. The gas turbine combustor according to claim 2, wherein the first air stoichiometric ratio of the pre-mixed fuel-air gas mixture supplied to the second group of the main nozzles by said first means for supplying is approximately 2.5 at a start of an operation of the gas turbine combustor.

* * * * *